US010822139B2

(12) United States Patent
Wondra et al.

(10) Patent No.: US 10,822,139 B2
(45) Date of Patent: Nov. 3, 2020

(54) FLUID MANAGEMENT DEVICE AND FLUID COLLECTION SYSTEM

(71) Applicants: Matthew Wondra, West Bend, WI (US); Richard Wondra, Lomira, WI (US); Lee Wondra, Mayville, WI (US)

(72) Inventors: Matthew Wondra, West Bend, WI (US); Richard Wondra, Lomira, WI (US); Lee Wondra, Mayville, WI (US)

( * ) Notice: Subject to any disclaimer, the term of this patent is extended or adjusted under 35 U.S.C. 154(b) by 153 days.

(21) Appl. No.: 15/887,303

(22) Filed: Feb. 2, 2018

(65) Prior Publication Data

US 2018/0222627 A1 Aug. 9, 2018

Related U.S. Application Data

(60) Provisional application No. 62/454,408, filed on Feb. 3, 2017.

(51) Int. Cl.
*B65D 5/72* (2006.01)
*B67C 11/02* (2006.01)
*B65D 77/06* (2006.01)
*B65D 5/64* (2006.01)

(52) U.S. Cl.
CPC ..... *B65D 5/72* (2013.01); *B65D 5/64* (2013.01); *B65D 77/061* (2013.01); *B67C 11/02* (2013.01)

(58) Field of Classification Search
CPC ..... B65D 5/72; B65D 5/64; B65D 77/061; B67C 11/02
See application file for complete search history.

(56) References Cited

U.S. PATENT DOCUMENTS 5,577,539 A * 11/1996 Shaw ..... B67C 11/02 141/106

* cited by examiner

*Primary Examiner* — P. Macade Nichols
(74) *Attorney, Agent, or Firm* — Boardman & Clark LLP

(57) ABSTRACT

A fluid management device is disclosed. The fluid management device includes a fluid collection member that extends the entire length and width of a bulk storage container. The fluid collection member has a generally concave surface which directs fluid to a drain opening that is aligned with an opening in the storage container. A bulk storage container having a fluid management device is also disclosed.

10 Claims, 13 Drawing Sheets

FLUID MANAGEMENT DEVICE AND FLUID COLLECTION SYSTEM

CROSS-REFERENCE TO RELATED APPLICATIONS

This application claims priority to U.S. Provisional Patent Application, Ser. No. 62/454,408, filed Feb. 3, 2017, entitled FLUID MANAGEMENT DEVICE & FLUID COLLECTION SYSTEM, the entire contents of which is hereby incorporated by reference in its entirety herein.

FIELD

The present inventions relate to the field of containers. The present inventions more specifically relate to the field of fluid handling systems and fluid management devices for containers.

BACKGROUND

Intermediate Bulk Containers (IBC), IBC totes, and/or pallet tanks are well known industrial containers designed for the transport and storage of bulk fluid substances, such as liquid and granulated substances (among others), in a variety of commercial areas.

While an IBC may be made from a variety of different materials, a common IBC is a plastic composite container, often housed within a tubular galvanized iron or steel cage or frame. The cage or frame may be attached to a pallet. Alternatively, some IBCs are made of more durable or reinforced material and therefore may be used without the steel cage or frame.

Once the IBC is emptied of its original components, it may be reused. Currently, in order to re-use or repurpose an IBC for use/storage of liquids, a basic funnel is used. The funnel is placed on top of the IBC in an opening of the IBC to funnel fluids into the interior or cavity of the container. Some existing examples are basic round funnels that are barely larger than the opening in the top of the IBC.

Unfortunately, the existing technology is only large enough to funnel the fluids into the IBC and uses very little of the top surface of the IBC. Moreover, the existing technology does not provide an area to simultaneously store and drain or drip dry fluid containing devices which are drained into the IBC.

SUMMARY

Accordingly, a fluid management device provided. In one or more examples of embodiments, the device disclosed herein utilizes the entire width and length of the top of the IBC to funnel fluids into the IBC. The device also acts as a holding device to hold filters, pans, funnels, pales, etc. which may be placed on top of the device (on the IBC), allowing these devices to sit and continue to drain onto the fluid management device, which then funnels the drained fluid into the IBC.

Moreover, the device disclosed herein creates an organized place to store messy fluid devices like oil filters, oil pans, pales, funnels, etc. while they drip dry. The device simultaneously catches this drained fluid and funnels it into the IBC where it is contained and stored until the container is full. The fluid management device thereby creates a fluid collection system by utilizing an IBC. As indicated, the device disclosed herein may utilize the entire surface area of the IBC top to collect fluids to funnel them into the IBC while also holding the containers the fluids were in so that they can drip dry, keeping a clean work area and a place to store wet containers while their fluids drip off.

Accordingly, a fluid management device is provided which includes a fluid collection member that extends the entire length and width of a top of a bulk storage container, such as an IBC storage container. The fluid collection member has a generally concave surface which directs fluid to a drain opening that is aligned with an opening in the storage container.

A fluid management device is also provided. The fluid management device has a base member with a plurality of channel forming members spaced about a first drain opening and an outer perimeter having a plurality of top member supports. A top member is seated on the base member and supported by one or more of the plurality of top member supports and plurality of channel forming members. The top member has an outer rim, a plurality of perimeter supports spaced about a perimeter of the top member, a plurality of intermediate supports spaced about a surface of the top member, and a second drain opening which is aligned with the first drain opening of the base member. The top member has a generally concave upper surface which directs fluid toward the first and second drain openings. The top member also has one or more perimeter supports and intermediate supports. A screen is seated on the top member and supported by one or more of the one or more perimeter supports and intermediate supports.

A bulk storage container with a fluid management device is also disclosed. The bulk storage container has an opening on a top of the container. A fluid collection member is provided on the top of the container and extending the entire length and width of the bulk storage container. The fluid collection member has a generally concave surface which directs fluid to a drain opening that is aligned with the opening in the storage container. A planar platform is seated on the fluid collection member. The planar platform has one or more apertures allowing fluid to drain from the platform into the fluid collection member.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Figure 1:
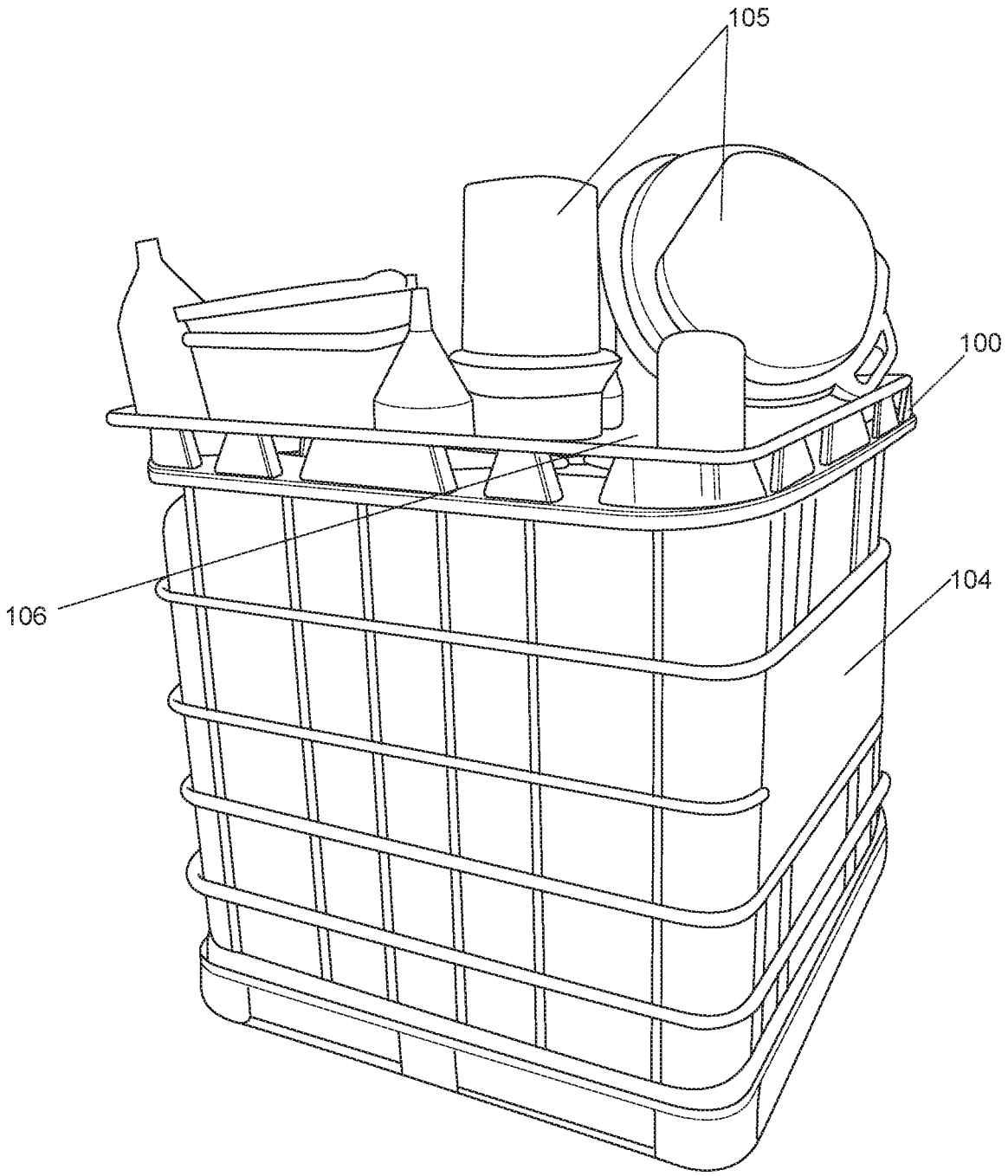
FIG. 1 is a perspective view of a fluid management device and fluid collection system according to one or more examples of embodiments, showing the device with one or more items placed thereon to drain.

Referring to the Figures, a fluid management device 100 is described. Generally, a fluid management device 100 is provided which forms a fluid collection system that is seated on the top of a bulk storage container 104 and may hold one or more items 105 for storage or draining. As shown in FIG. 1, the fluid management device 100 of the fluid collection system may support one or more devices or items 105 to allow said devices to drain into the container 104. The device 100 may extend the entire length and width of a top 102 of a bulk storage container 104, such as an IBC storage container. While IBC may be specifically referenced herein, reference is made to IBC for purposes of example only and it is understood that a variety of bulk storage containers may be substituted for the IBC.

FIGS. 1-10 illustrate one or more examples of embodiments of a fluid management device 100 and fluid collection system for a bulk container 104 as described herein. More specifically, a bulk storage container 104 with a fluid management device 100 is also disclosed. The bulk storage container 104 has an opening 112 on a top 102 of the container. A fluid management device 100 with a fluid collection member 106 is provided on the top 102 of the container 104 and extends the entire length and width of the bulk storage container 104. The fluid collection member 106 has a generally concave surface 108 which directs fluid to a drain opening 110 that is aligned with the opening 112 in the storage container 104. The device 100 with collection member 106 is seated on an IBC container or storage tank 104. In combination, the components described form one or more examples of a fluid collection system.

Figure 2:
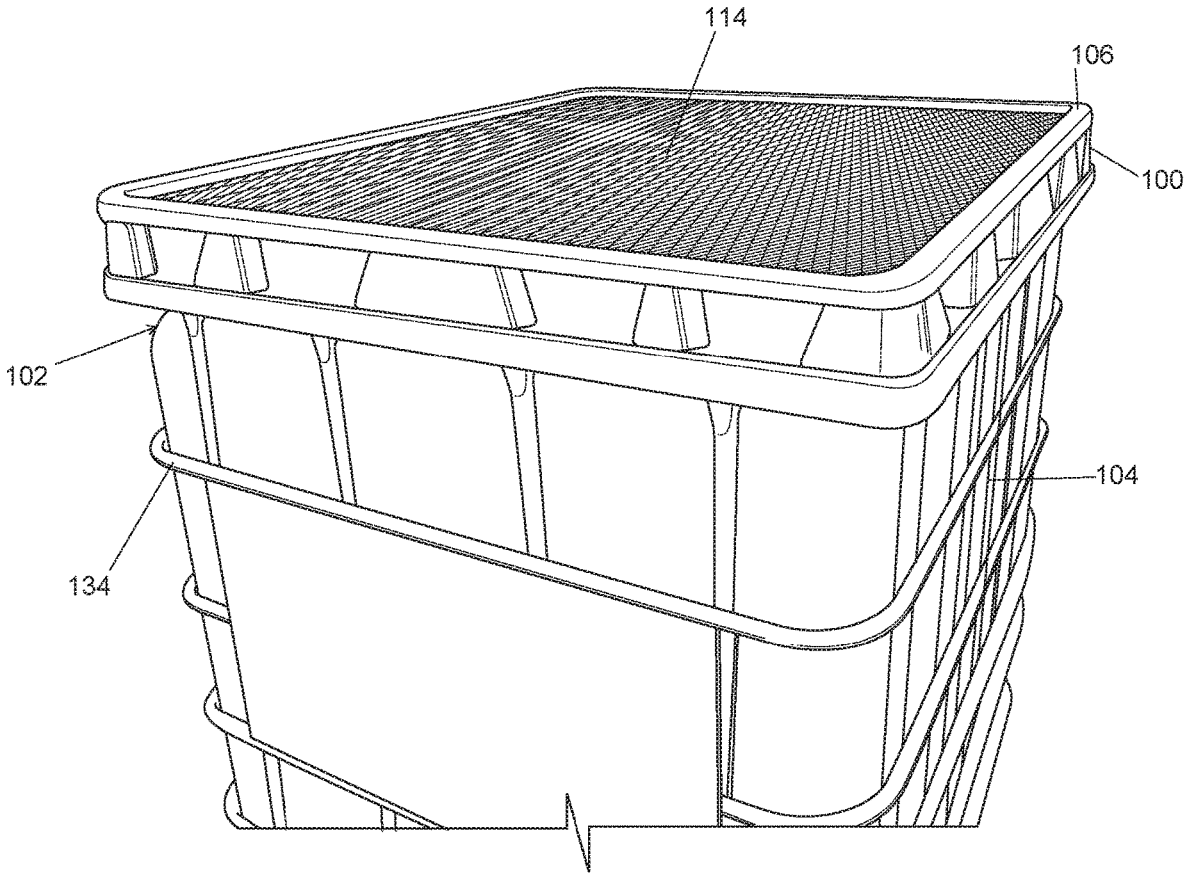
FIG. 2 is a partial perspective view of a fluid management device and fluid collection system, showing a fluid management device on a bulk storage container according to one or more examples of embodiments.
Figure 3:
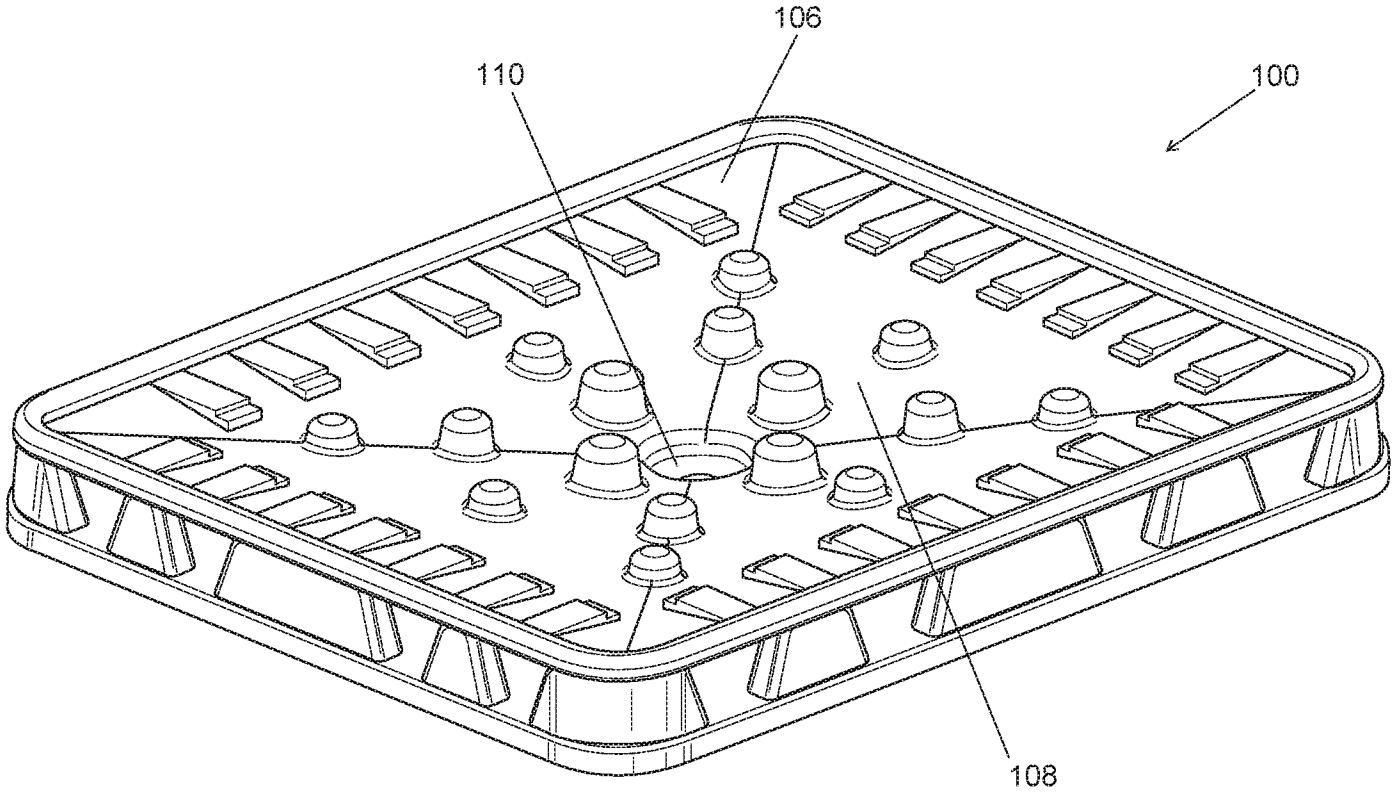
FIG. 3 is a perspective view of a fluid management device according to one or more examples of embodiments, showing the fluid management device without a screen.

As can be seen in FIG. 2, the fluid management device 100 includes a fluid collection member 106 which may support or otherwise has thereon a screen 114 or other approximately planar platform with one or more apertures therein. The screen 114 is retained or seated on the collection member 106. A planar platform 114 is seated on the fluid collection member 106. The planar platform 114 has one or more apertures allowing fluid to drain from the platform into the fluid collection member 106. In the embodiment shown in the Figures, the platform 114 is a screen or mesh. While a screen 114 is shown in one or more examples of embodiments, it is understood that the fluid management device 100 described herein may be used or provided without the screen. Likewise, while the foregoing devices are described as planar, variations thereon may also be acceptable.

Figure 4:
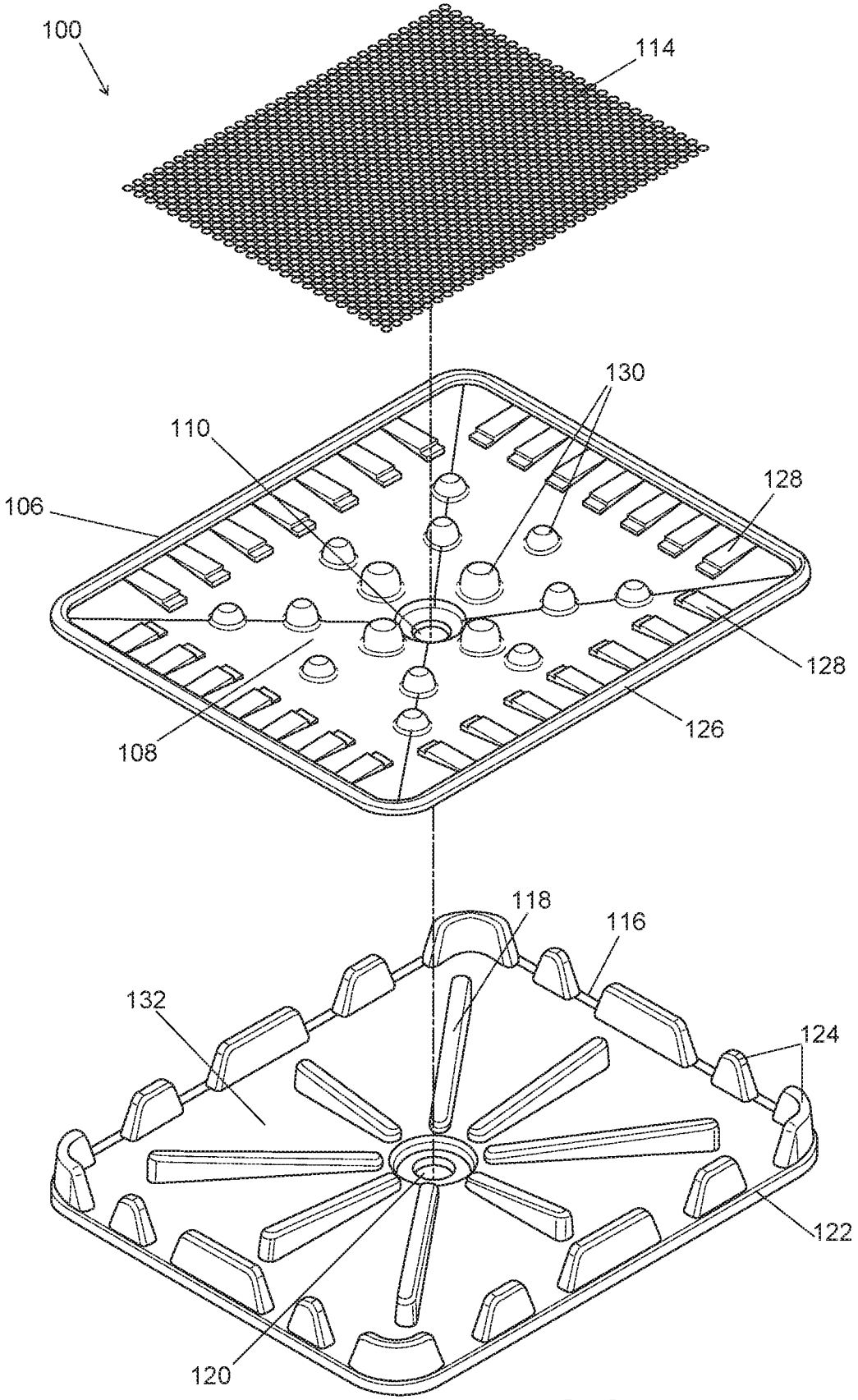
FIG. 4 is an exploded perspective view of a fluid management device according to one or more examples of embodiments.

Referring to FIG. 4, an exploded view of one or more examples of embodiments of the fluid management device 100 is shown. The fluid management device 100 in the illustrated example is comprised of a plurality of structural members which may be joined together. The fluid management device 100 has a base member 116 that supports the fluid collection member 106, which is formed by a top member seated on the base member 116. The collection member may be a combination of the top member and base member in one or more particular embodiments. In the illustrated example, the top member 106 has an outer rim 126, a plurality of perimeter supports 128 spaced about a perimeter of the top member 106, a plurality of intermediate supports 130 spaced about a surface of the top member 106, and a drain opening 110 which is aligned with the drain opening 120 of the base member 116. That is, the base member 116 is provided which may be seated on a bulk storage container 104 such that its drain opening 120 aligns with an opening 112 in the storage container 104 and aligns with the drain opening 110 in the top member 106 which is seated on the top of the base member 116 (see also FIGS. 6, 9-10). The top member 106 has a generally concave upper surface 108 which directs fluid toward the first and second drain openings 120, 110. The top member 106 also has one or more perimeter supports 128 and intermediate supports 130 (discussed in further detail below).

In one or more preferred examples of embodiments, the base member 116 extends the entire width and length of the top 102 of the bulk storage container 104. The base member 116 has a plurality of channel forming members 118 spaced about the drain opening 120 and an outer perimeter 122 having a plurality of top member supports 124. The top member supports 124 may support the top member 106. The channel forming members 118 may also support the top member 106. In one or more examples of embodiments, the base member 116 may have a generally concave upper surface 132 sloped toward the drain opening 120. Alternatively, the base member 116 may have a flat upper surface 132. As a further alternative, the base member 116 (and optionally surface 132) may be contoured to mate with the top 102 of the storage container 104.

Figure 5:
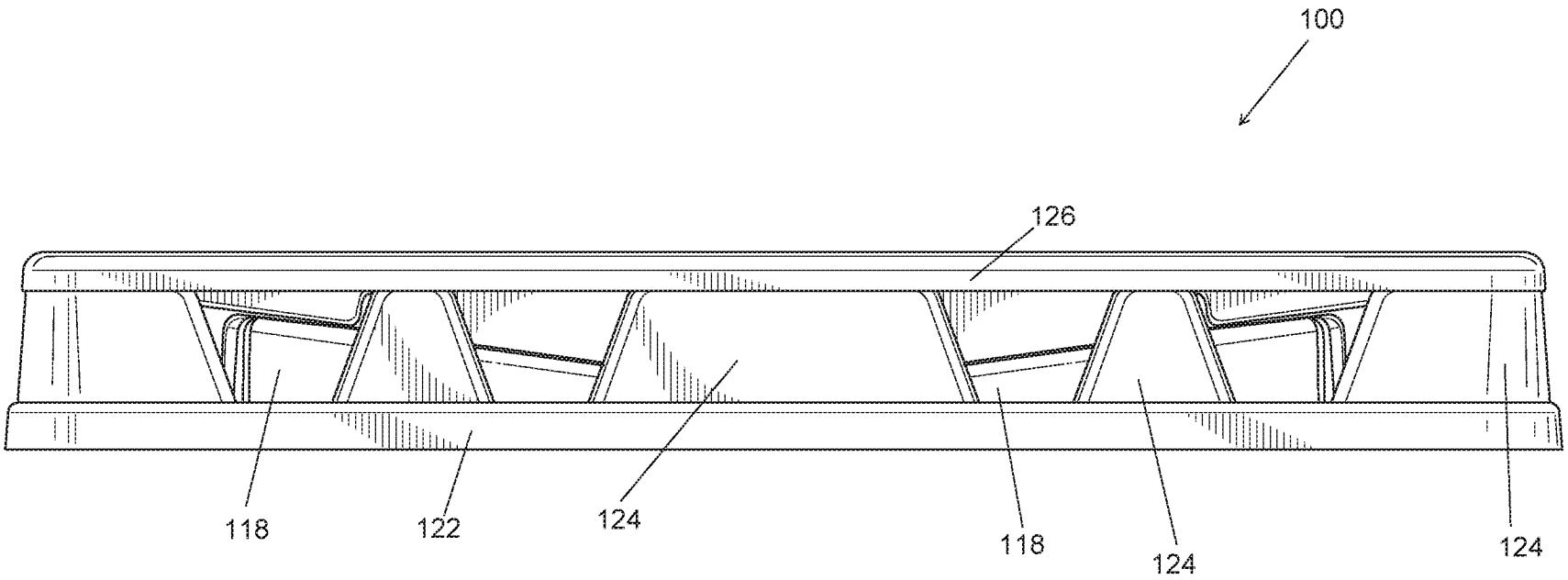
FIG. 5 is a side elevation view of a fluid management device according to one or more examples of embodiments.

An assembled or joined top member 106 and base member 116 are shown in FIG. 5. As discussed, the top member 106 has an outer rim 126, a plurality of perimeter supports 128 spaced about the perimeter of the top member 106, and a plurality of intermediate supports 130 or screen support posts spaced about the surface of the top member 106. The top member 106 also has a drain opening 110 which may be aligned with the drain opening 120 of the base member 116. The top member 106 which may form the fluid collection device has a generally concave upper or top surface 108 which directs fluid toward the drain opening 110.

Referring again to FIG. 4, the top member 106, and in particular, the perimeter supports 128 and intermediate supports 130, may receive and support the screen 114, which is a generally planar screen 114 sized to fit within the outer rim 126 of the top member 106. As indicated above, while a screen 114 is shown in one or more examples of embodiments, it is understood that the fluid management device 100 described herein may be used or provided with an alternative device accomplishing the same purpose or without the screen. Moreover, the various components may be secured together or may rest on top of one another.

Figure 6:
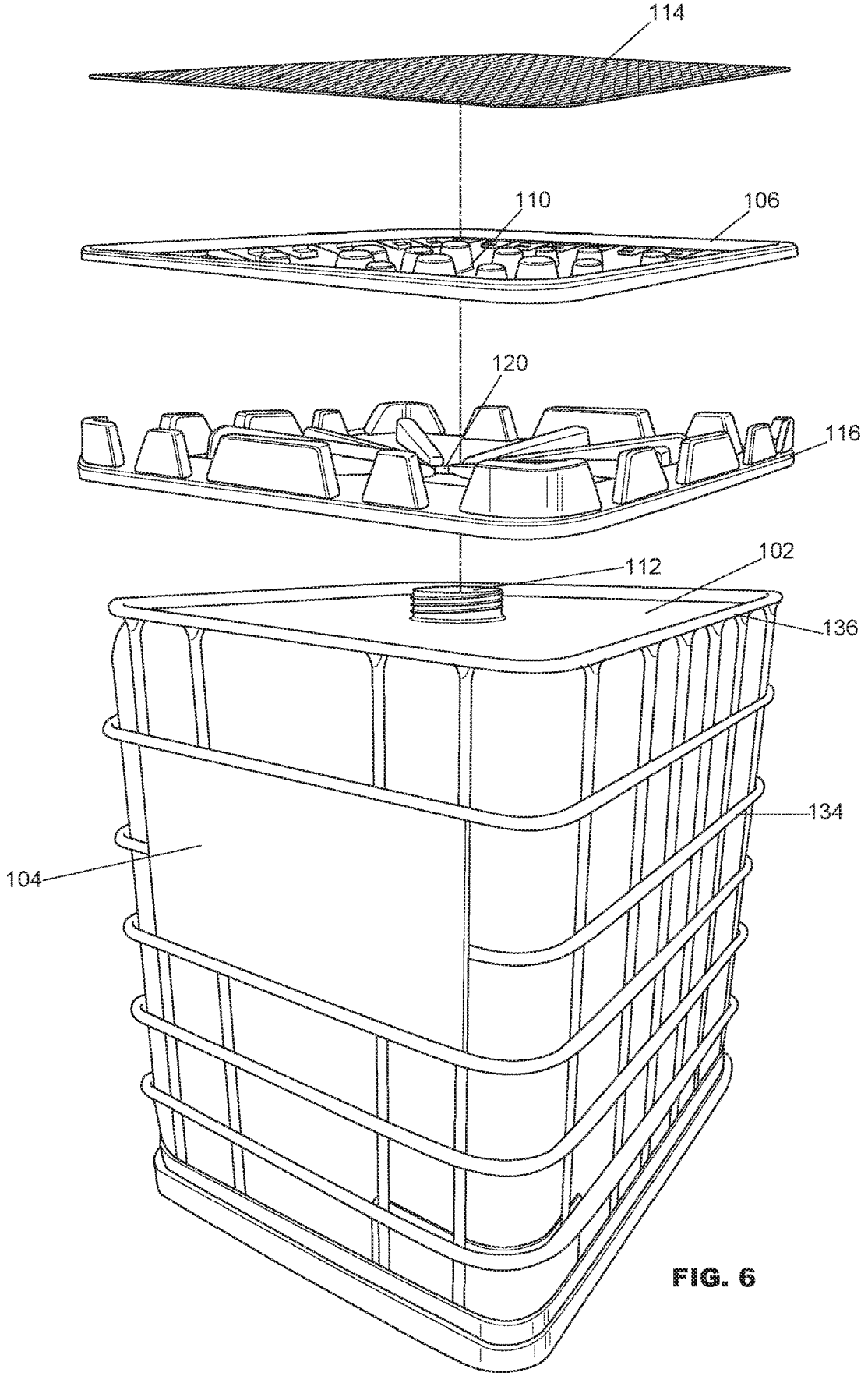
FIG. 6 is an exploded perspective view of a fluid management device and fluid collection system according to one or more examples of embodiments.
Figure 7:
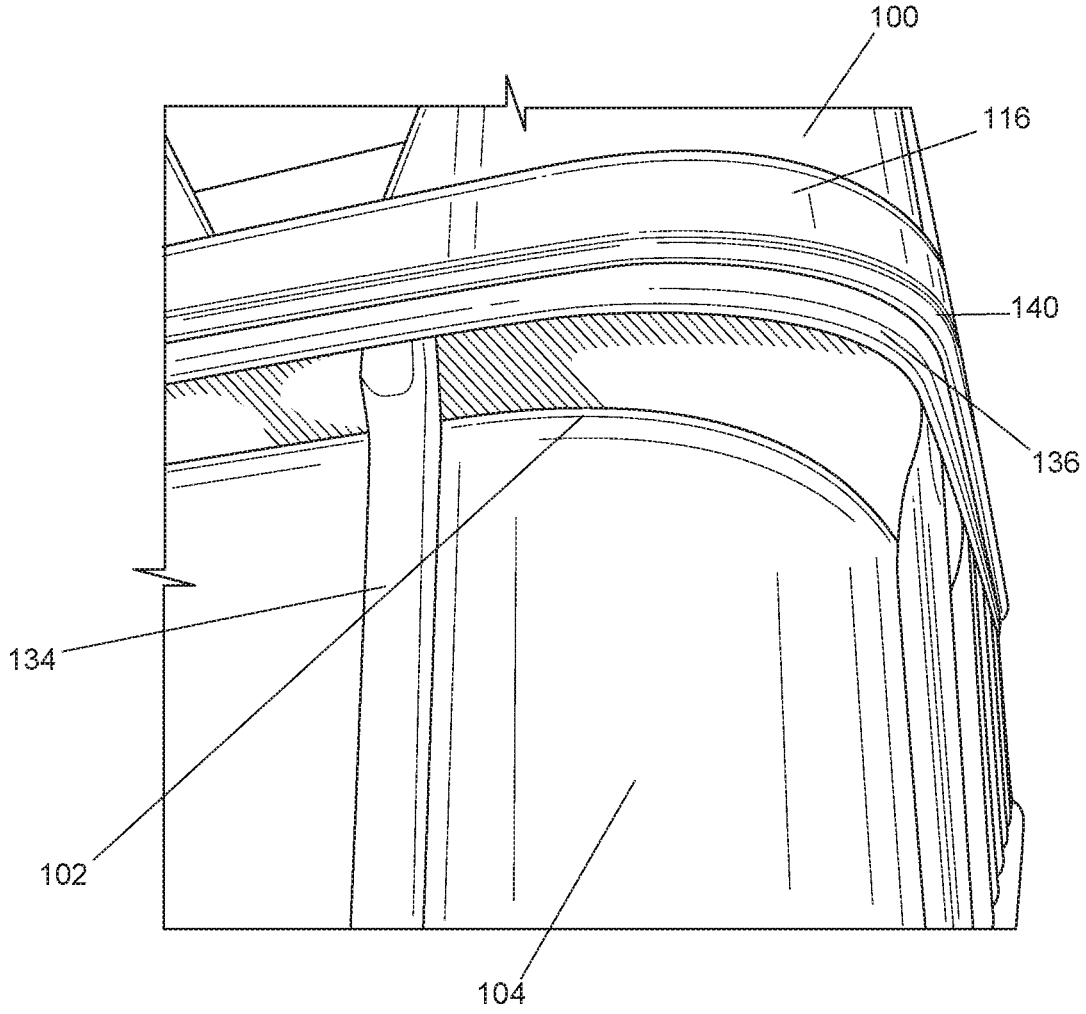
FIG. 7 is a partial perspective view of the fluid management device on a bulk storage container, showing the fluid management device seated on a frame of the bulk storage container.
Figure 8:
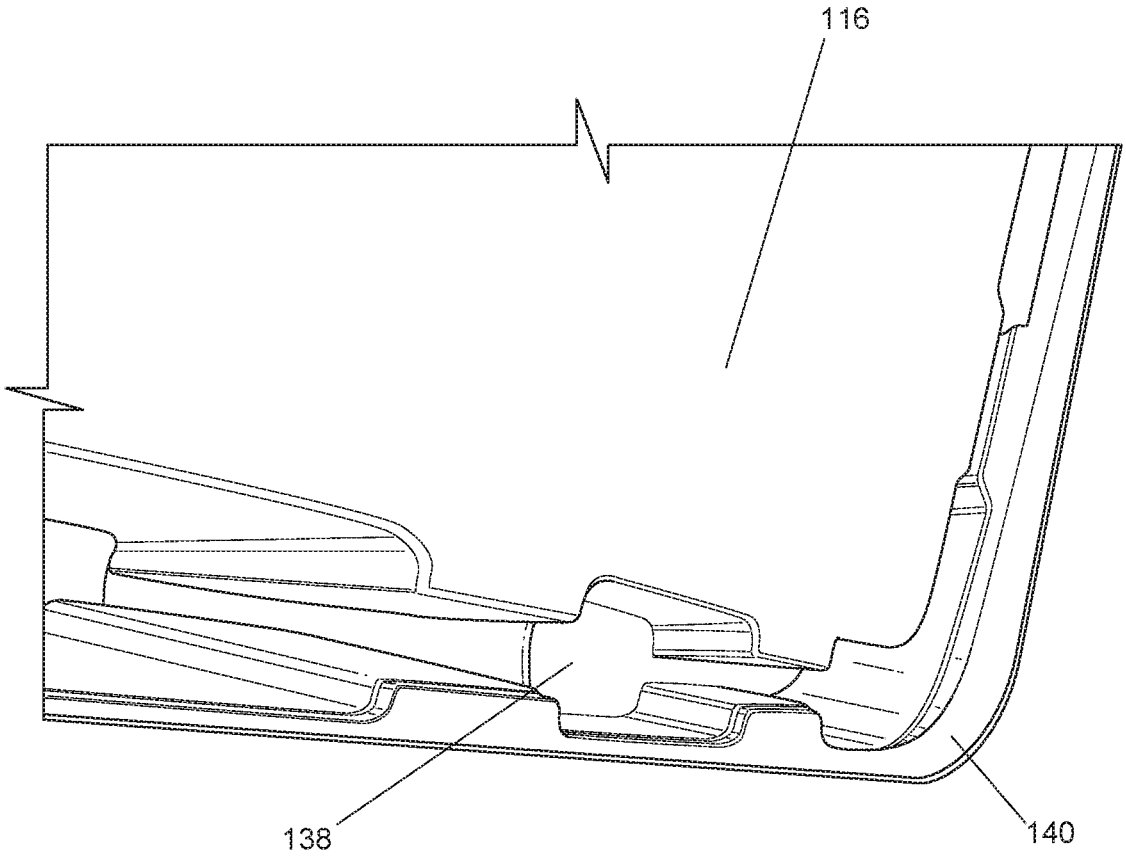
FIG. 8 is a partial perspective view of the fluid management device, showing a bottom surface of the fluid management device having a groove or recess therein.

As referenced above, and as can be seen in FIGS. 1-2, 6 the fluid management device 100 and base member 116 (when present) is received and supported by a bulk storage container 104 such as an IBC. In one or more examples of embodiments, the base member 116 may be seated on a frame structure 134 surrounding the bulk storage container 104 or IBC. Referring to FIGS. 7-8, in the illustrated example, the top rail 136 of the frame 134 of the IBC 104 may be received within a groove 138 or recess or channel in the base member 116 of the IBC. While a groove 138 is shown in the fluid management device 100 which may align with and receive one or more features of the IBC 104, the base member 116 may simply rest on the IBC container 104 or frame 134. In this regard, the base member 116 may be provided without a groove. In another example of embodiments, there may be a lip or overhang (not shown) on the IBC or IBC frame 134 which hangs over the frame 134 or top rail 136 and may help hold or engage the fluid management device 100. In a further example of embodiments, the fluid management device 100, e.g., the base member 116, may have a lip 140 which overhangs a portion of the IBC container 104 or container frame 134 or top rail 136. Alternative means of engaging the IBC 104 with the fluid management device 100 may also be used without departing from the overall scope of the present invention. Likewise, various fasteners may be used to secure the base member 116 to the IBC. Alternatively, as shown in FIGS. 11A-C and 12A-F, a series of spaced apart frame supports 142 may surround the periphery of the fluid management device 100, which support and engage the top 102 of the IBC or IBC frame 134 and which support a fluid collection device 206.

Figure 9:
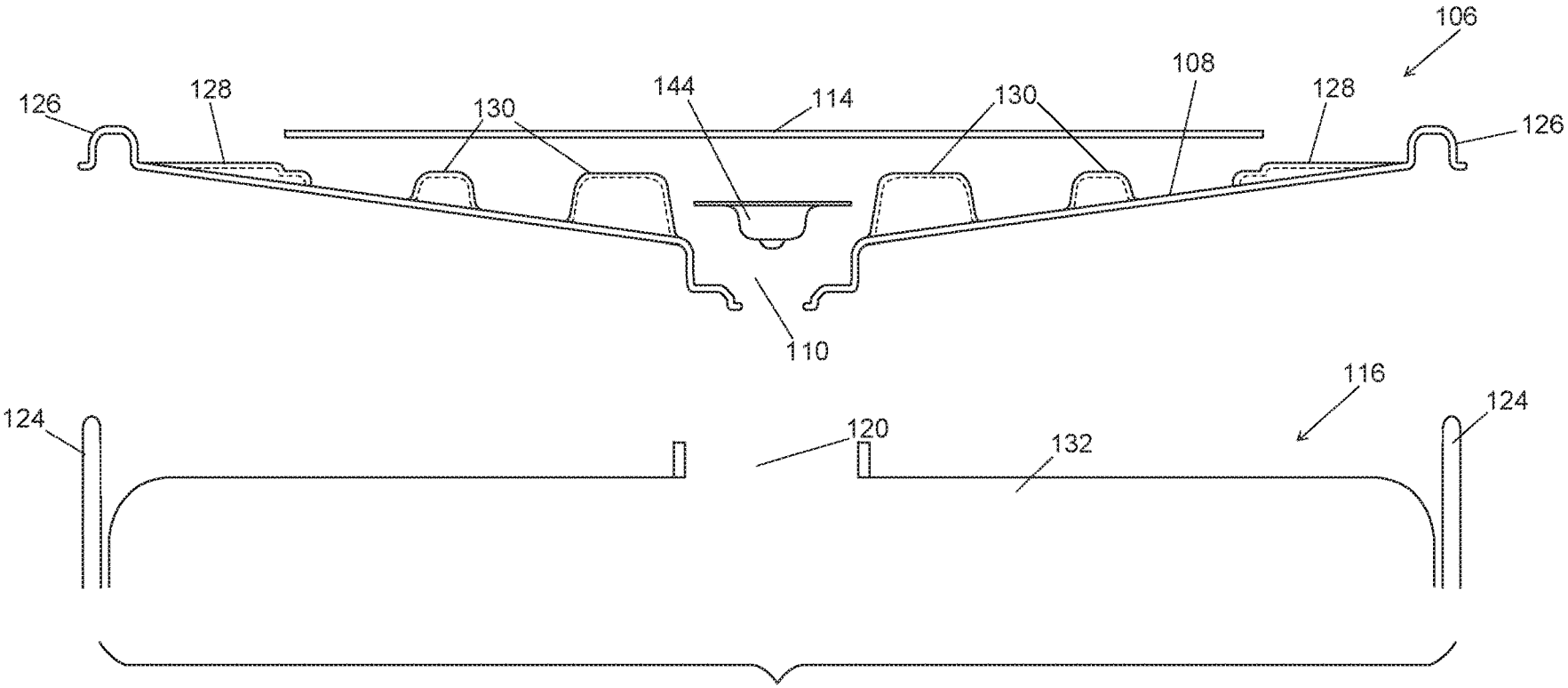
FIG. 9 is an exploded cross-sectional view of the fluid management device, showing a drain opening in the top member that is aligned with a drain opening in the base member, and including a screen and a strainer according to one or more examples of embodiments.
Figure 10:
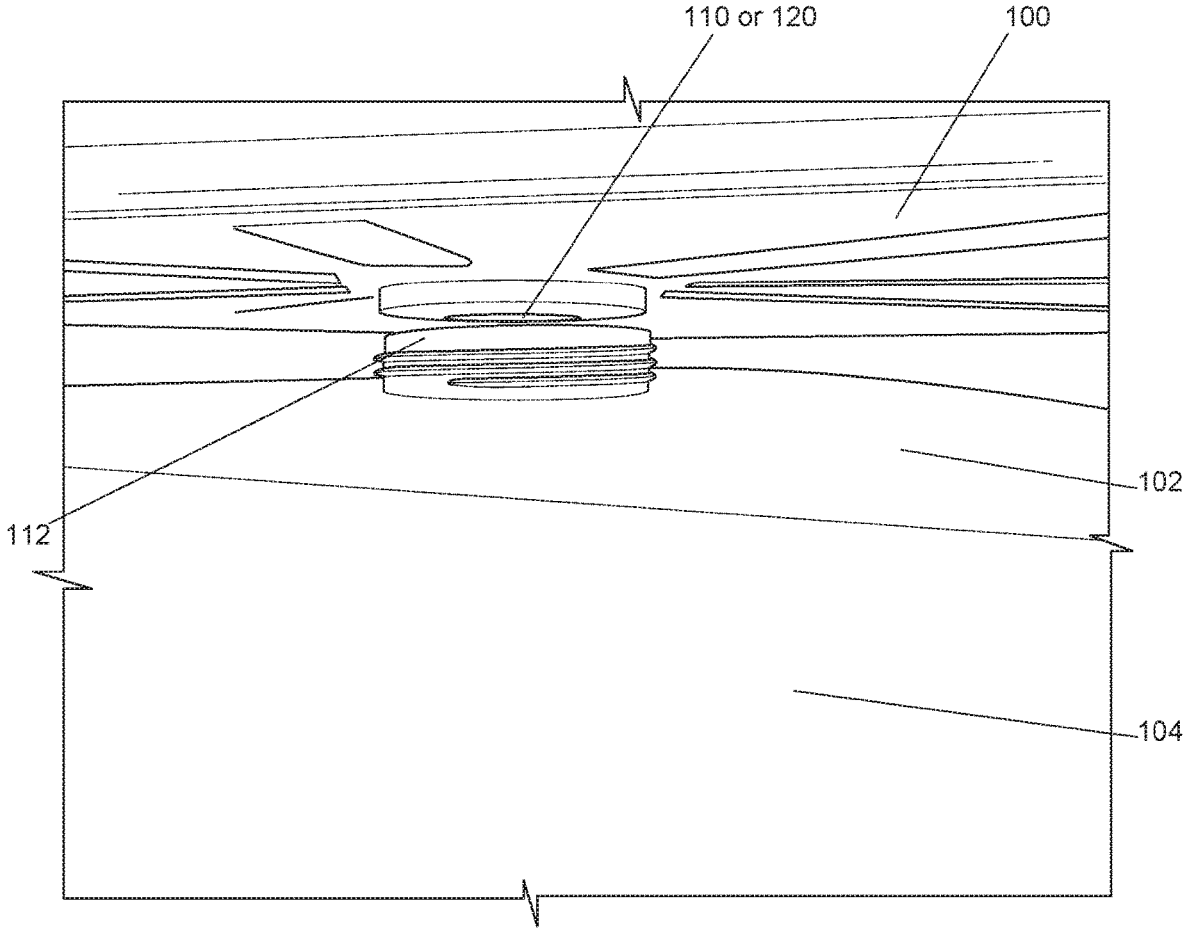
FIG. 10 is a partial perspective view of the fluid management device, showing an alignment of the drain opening of the fluid collection member or the base member of the fluid management device with an opening in a bulk storage container.
Figure 11A:
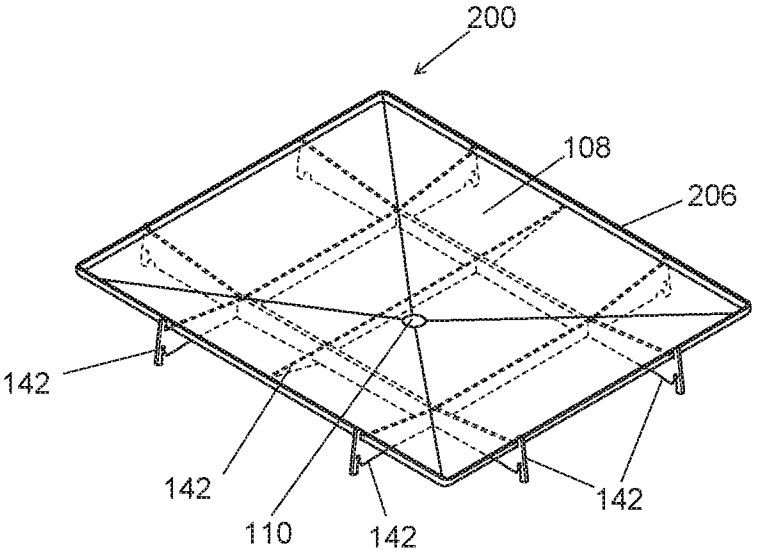
FIG. 11A is a perspective view of a fluid management device according to one or more alternative examples of embodiments.
Figure 11B:
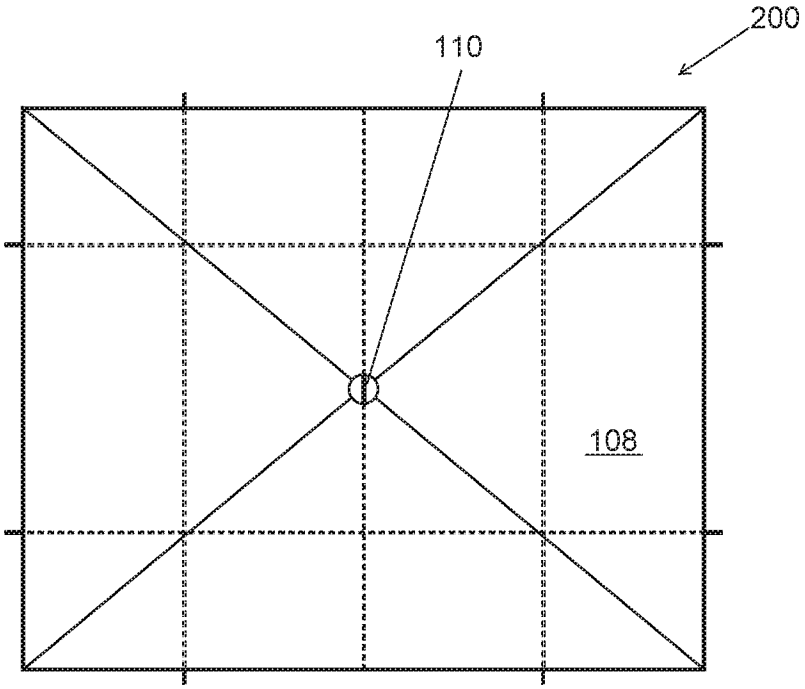
FIG. 11B is a top plan view of the fluid management device shown in FIG. 11A.
Figure 11C:
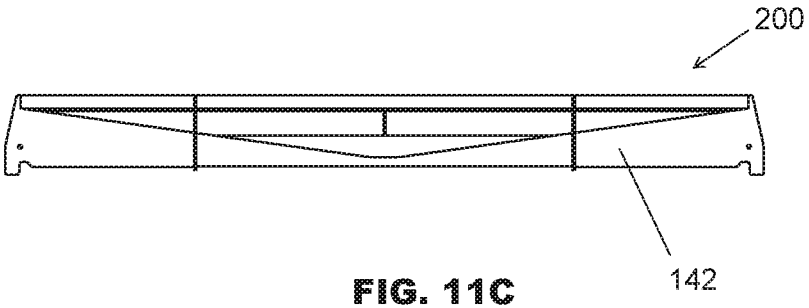
FIG. 11C is a side elevation view of the fluid management device shown in FIG. 11A.
Figure 12A:
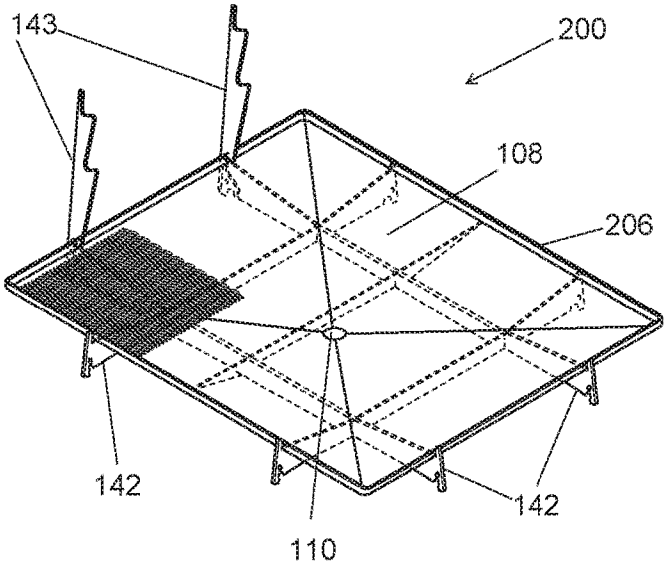
FIG. 12A is a perspective view of the fluid management device shown in FIG. 11A having an additional support extending therefrom, according to one or more examples of embodiments.
Figure 12B:
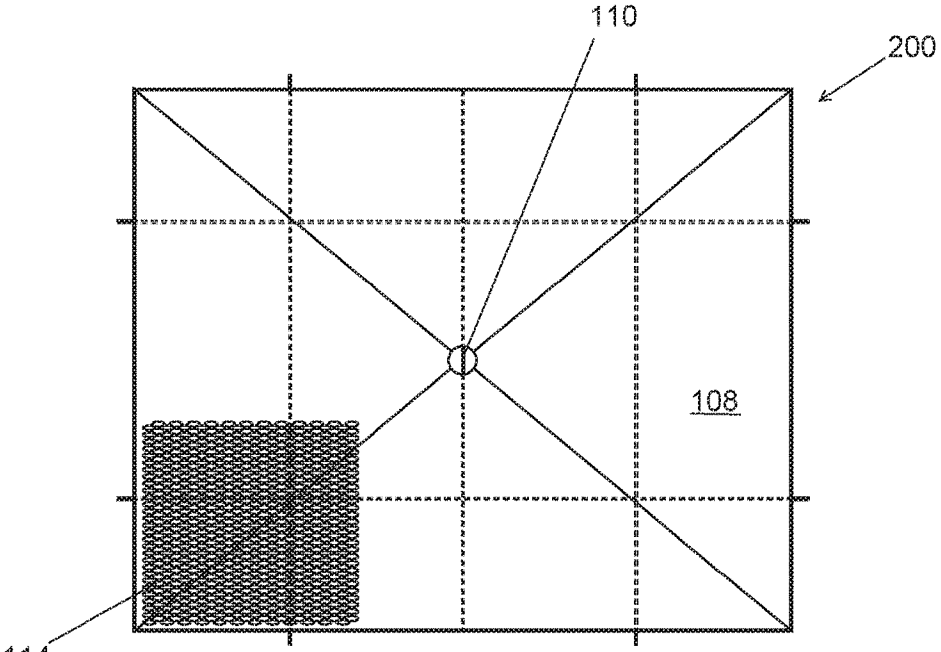
FIG. 12B is a top plan view of the fluid management device shown in FIG. 12A.
Figure 12C:
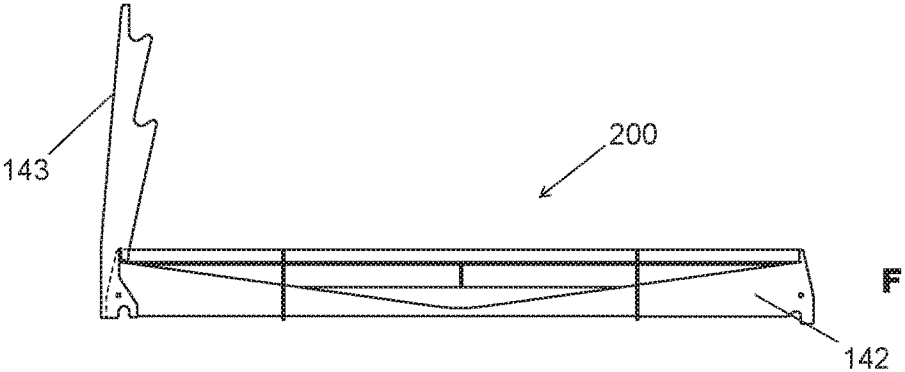
FIG. 12C is a side elevation view of the fluid management device shown in FIG. 12A.
Figure 12D:
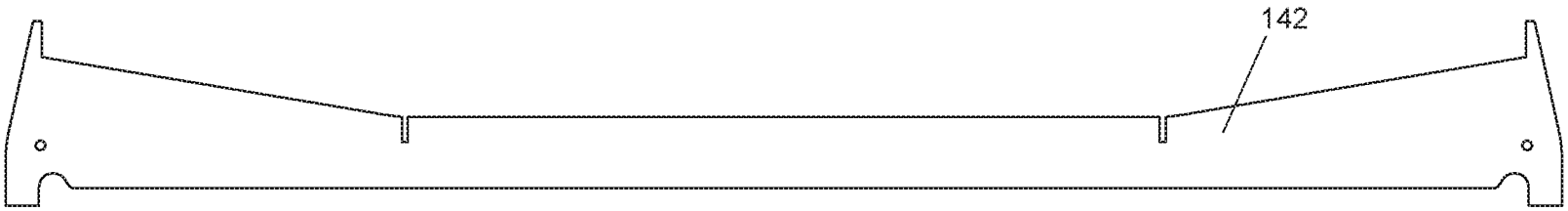
FIG. 12D is a side elevation view of one or more examples of embodiments of the frame supports used in association with the fluid management device shown in FIGS. 11A and 12A.
Figure 12E:
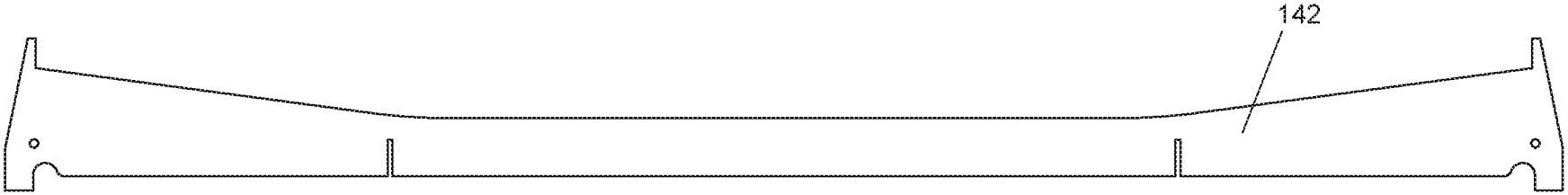
FIG. 12E is a side elevation view of one or more examples of embodiments of the frame supports used in association with the fluid management device shown in FIGS. 11A and 12A.
Figure 12F:
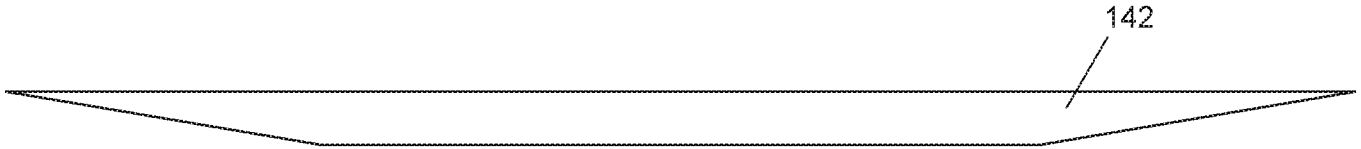
FIG. 12F is a side elevation view of one or more examples of embodiments of the frame supports used in association with the fluid management device shown in FIGS. 11A and 12A.

Referring again to FIGS. 7-8, the base member 116 (which supports the top member 106) is received and supported by the bulk storage container 104. In the example shown, the base member 116 is seated on the frame structure 134 surrounding the container. In this arrangement, the drain openings 120, 110 of the base member 116 and top member 106 are aligned with the opening 112 of the bulk storage container 104 as can be seen in FIGS. 9-10. As shown in the illustrated example of FIG. 9, a strainer 144 may also be provided in the drain opening 110, for instance, to filter the content drained into the storage container 104.

One or more alternative examples of embodiments of a fluid management device 200 are shown in FIGS. 11A-C, 12A-F. In the examples shown, the fluid management device 200 may be substantially similar to the fluid management device 100 described herein and like numbers are used to illustrate like components. According to one or more examples of embodiments, the fluid management device 200 may include a fluid collection device 206 which has a concave surface 108 that may direct fluid to a drain opening 110. The fluid collection device 206 is supported by one or more frame supports 142 that may be arranged to engage the top 102 of a bulk storage container 104 or frame 134 thereof. A screen 114 may also be seated on the top of the fluid collection device 206. In one or more additional examples of embodiments, as shown in FIGS. 12A-F, additional supports 143 may be provided to provide for multiple fluid collection devices 206 which may be arranged in a stacked assembly (not shown).

While the device described herein is described and shown to cover the entire top 102 surface of the bulk storage container 104, in one or more alternative embodiments the device may cover only a portion of the top surface of the container, such as but not limited to ½ or ¾ of the top 102 of the container. Moreover, while one or more surfaces are described as concave, any suitable slope or geometric arrangement may be acceptable to direct fluid to a desired location. Similarly, while the invention is illustrated and described to rest upon the metal frame 134 of an IBC 104 in one or more examples of embodiments, it is contemplated that the device may rest or be supported (in whole or in part) on the top 102 of the IBC or other bulk storage container 104. Alternatively, it is also contemplated that the device may be free standing, such as but not limited to, by a frame (e.g., a free standing frame structure) which supports the device 100 above the IBC or bulk storage container 104.

The device may be formed of a variety of durable materials or combinations of materials suitable for the purposes provided. In one example of embodiments, the device may be formed of a plastic or polymer. For example, the device may be formed of two plastic components or polymeric material components which may be fused or otherwise secured together. Alternatively, the device may also be formed from a single sheet of material. In another example of embodiments, the device may be formed of plastic and may include one or more metal components, such as a steel or other metal drain surface. In another example of embodiments, the entire device may be formed of steel or other metal.

The device may be formed by a variety of means. For example the device may be formed by thermo forming or vacuum forming of one or more plastic sheets of material. In another example, the device may be formed by molding, such as, but not limited to injection molding. In a further example of embodiments, a metal device may be cast or molded. In an additional example, a metal drain surface or screen may be formed of a metal sheet which is a stamped or punched sheet, or alternatively may be an expanded metal grid-type sheet; however, the screen may also be formed of a durable molded plastic.

In operation, the fluid management device 100 is placed on top 102 of a bulk storage container 104 or an IBC and forms a fluid collection system. In one or more examples of embodiments shown in the Figures, the device 100 may be positioned and rest upon the frame 134 of the IBC. In position, the drain 110 of the device 100 is aligned with or inserted into an opening 112 in the top 102 of the IBC 104. As indicated, a screen 114 may be provided on the top of the fluid management device 100. One or more items 105, such as funnels, filters, oil cans, pales, etc. may be placed on top of the screen 114 or device 100 or 106 and allow liquids to run off, through the fluid management device 100, and down into the drain provided at the base of the device and funneling into the IBC 104 for storage.

Advantageously, the device disclosed herein utilizes the entire width and length of the top of the bulk storage container or IBC to funnel fluids into the container. The device also acts as a holding device to hold filters, pans, funnels, pales, etc. which may be placed on top of the device (on the IBC), allowing these devices to sit and continue to drain onto the fluid management device and drip dry, which then funnels the drained fluid into the container. In this regard, the device disclosed herein creates an organized place to store messy fluid devices like oil filters, oil pans, pales, funnels, etc. while they drip dry. The device also catches this fluid and funnels it into the storage container where it is contained and stored until the container is full.

Advantageously, the fluid management device described herein has a generally flat surface, such that a container may be set onto the surface and allow fluid to drain off or out and into the bulk storage container or IBC. Moreover, the invention described herein covers the entire top of the bulk storage container or IBC and acts as a giant funnel, whereas other funnel devices may only cover a small area of the IBC surface and do not have the fluid capacity or the storage space to hold containers in the manner and quantity provided by the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A fluid management device comprising:

a base member having a plurality of channel forming members spaced about a first drain opening and an outer perimeter having a plurality of top member supports;

a top member seated on the base member and supported by one or more of the plurality of top member supports and plurality of channel forming members, the top member having an outer rim, a plurality of perimeter supports spaced about a perimeter of the top member, a plurality of intermediate supports spaced about a surface of the top member, and a second drain opening which is aligned with the first drain opening of the base member, the top member having a generally concave upper surface which directs fluid toward the first and second drain openings, and the top member having one or more perimeter supports and intermediate supports; and a screen seated on the top member and supported by one or more of the one or more perimeter supports and intermediate supports.

2. The fluid management device of claim 1, wherein the base member is seated on a bulk storage container and the first and second drain openings are aligned with an opening in the storage container.

3. The fluid management device of claim 2, wherein the base member extends the entire width and length of a top of the bulk storage container.

4. The fluid management device of claim 2, wherein the bulk storage container is an IBC container.

5. The fluid management device of claim 4, wherein the base member is seated on a frame structure surrounding the IBC container.

6. The fluid management device of claim 4, wherein a top rail of the frame structure is received within a groove in the base member.

7. The fluid management device of claim 2, wherein a lip on the base member overhangs the container.

8. The fluid management device of claim 1, wherein the base member has a generally concave upper surface.

9. The fluid management device of claim 1, wherein the fluid management device is supported by spaced apart frame supports.

10. The fluid management device of claim 1 composed of a polymeric material.

* * * * *